US011849902B2

(12) United States Patent
Sanchez

(10) Patent No.: US 11,849,902 B2
(45) Date of Patent: Dec. 26, 2023

(54) STOWABLE DISH DRYING RACK SYSTEM

(71) Applicant: Michael Sanchez, Pearland, TX (US)

(72) Inventor: Michael Sanchez, Pearland, TX (US)

( * ) Notice: Subject to any disclaimer, the term of this patent is extended or adjusted under 35 U.S.C. 154(b) by 0 days.

(21) Appl. No.: 17/591,428

(22) Filed: Feb. 2, 2022

(65) Prior Publication Data

US 2023/0240509 A1 Aug. 3, 2023

(51) Int. Cl.
*A47L 19/04* (2006.01)
*A47B 77/14* (2006.01)

(52) U.S. Cl.
CPC ..... *A47L 19/04* (2013.01); *A47B 77/14* (2013.01)

(58) Field of Classification Search
CPC ..... A47F 5/101; A47F 5/10; A47F 7/0064; A47G 23/0208; A47G 19/10; A47G 19/08; A47B 81/04; A47B 77/14; A47J 47/16; A47L 19/04
USPC ..... 211/41.2, 41.3, 41.5, 41.6
See application file for complete search history.

(56) References Cited

U.S. PATENT DOCUMENTS 2,839,349 A * 6/1958 Culver ..... A47B 88/48 312/334.15
4,436,352 A * 3/1984 Okada ..... A47L 19/04 312/238
4,700,849 A * 10/1987 Wagner ..... A47B 81/04 211/74
4,807,764 A * 2/1989 Bellin ..... A47B 88/407 211/94.01
5,215,364 A * 6/1993 Moore ..... B42F 17/20 40/775
5,255,818 A * 10/1993 Zeigler ..... A47F 1/085 221/45
5,396,993 A * 3/1995 Spitler ..... A47J 47/16 248/37.3
5,485,927 A 1/1996 Hubbard
5,743,438 A * 4/1998 Sokolnicki ..... B67D 1/06 211/74
5,957,558 A * 9/1999 Quade ..... A47B 88/48 312/246
6,336,692 B1 * 1/2002 Snyder ..... A47B 51/00 312/306
8,348,068 B2 * 1/2013 Huentelman ..... A47J 47/16 211/70.7
8,752,914 B1 * 6/2014 Simhoni ..... A47B 51/00 312/247
8,851,306 B2 * 10/2014 Spurr ..... A47B 46/005 211/117
8,973,763 B2 * 3/2015 Pargansky ..... A47L 19/04 211/16
D833,773 S * 11/2018 Spurr ..... D6/574
10,426,263 B1 * 10/2019 Whaley ..... A47B 77/14
11,266,261 B1 * 3/2022 Shoemaker, Jr. ..... F16B 45/00
D958,575 S * 7/2022 Beck ..... D6/705
2006/0138063 A1 * 6/2006 Johnson ..... A47L 19/04 211/41.3

(Continued)

*Primary Examiner* — Devin K Barnett

(57) ABSTRACT

A stowable dish drying rack system includes a mount for attachment to a bottom surface of a cabinet. A plate support is attached to the mount and is extendable vertically downwardly from the mount in a deployed position. The plate support receives vertically orientated plates such to facilitate drying of the plates. The plate support is positionable in a horizontal orientation in a stored position when the plate support is free of the plates.

13 Claims, 7 Drawing Sheets

(56) References Cited

U.S. PATENT DOCUMENTS

| | | | | |
|---|---|---|---|---|
| 2007/0131629 | A1* | 6/2007 | Sullivan | A47L 19/04 211/41.3 |
| 2010/0043249 | A1 | 2/2010 | Mulaw | |
| 2012/0138550 | A1* | 6/2012 | Wisniewski | A47L 19/04 211/41.3 |
| 2015/0201750 | A1* | 7/2015 | Hopkins | A47B 73/008 211/75 |
| 2015/0305594 | A1* | 10/2015 | Jarl | A47L 19/04 211/41.5 |
| 2015/0351570 | A1* | 12/2015 | Lukjan | A47B 77/14 211/70.7 |
| 2016/0088933 | A1* | 3/2016 | Rossignol | A47B 96/025 312/270.2 |
| 2016/0143485 | A1* | 5/2016 | Rinck | A47B 77/14 211/116 |
| 2020/0205565 | A1* | 7/2020 | Rinck | A47B 77/14 |
| 2022/0087417 | A1* | 3/2022 | Lukjan | A47B 96/021 |
| 2022/0273097 | A1* | 9/2022 | Beck | A47B 73/008 |

* cited by examiner

STOWABLE DISH DRYING RACK SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dish drying rack device and more particularly pertains to a new dish drying rack device which can be stored upwardly under a cabinet to free additional countertop space that otherwise would be needed for a dish drying rack.

(2) Description of Related Art Including Information Disclosed Under 37 CFR 1.97 and 1.98

The prior art relates to dish drying rack devices that allow for saving space on countertops and within sinks.

BRIEF SUMMARY OF THE INVENTION

An embodiment of the disclosure meets the needs presented above by generally comprising a mount for attachment to a bottom surface of a cabinet. A plate support is attached to the mount and is extendable vertically downwardly from the mount in a deployed position. The plate support receives vertically orientated plates such to facilitate drying of the plates. The plate support is positionable in a horizontal orientation in a stored position when the plate support is free of the plates.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
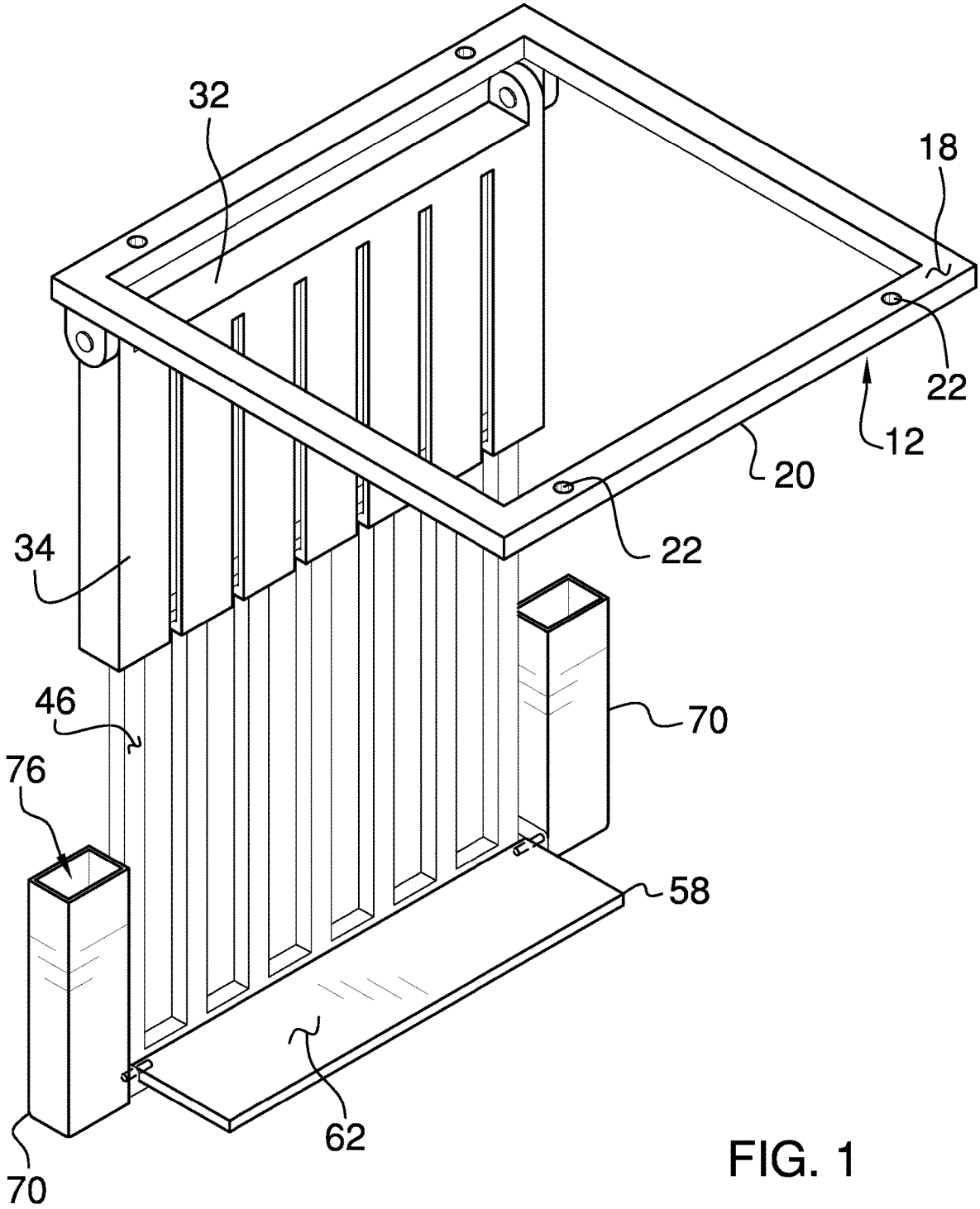
FIG. 1 is a top isometric view of a stowable dish drying rack system according to an embodiment of the disclosure.

With reference now to the drawings, and in particular to FIGS. 1 through 8 thereof, a new dish drying rack device embodying the principles and concepts of an embodiment of the disclosure and generally designated by the reference numeral 10 will be described.

As best illustrated in FIGS. 1 through 8, the stowable dish drying rack system 10 generally comprises a mount 12 that is configured for being attached to a bottom surface 14 of a cabinet 16. The mount 12 has an upper surface 18 and a lower surface 20. In one embodiment, a plurality of apertures 22 extends into the lower surface 20 and through the upper surface 18. A plurality of fasteners 24 extends through the mount 12 and into the bottom surface 14 of the cabinet 16 wherein each of the apertures 22 has one of the fasteners 24 therein. Alternate embodiments may include conventional brackets or adhesives to secure the mount 12 to the cabinet 16.

Figure 2:
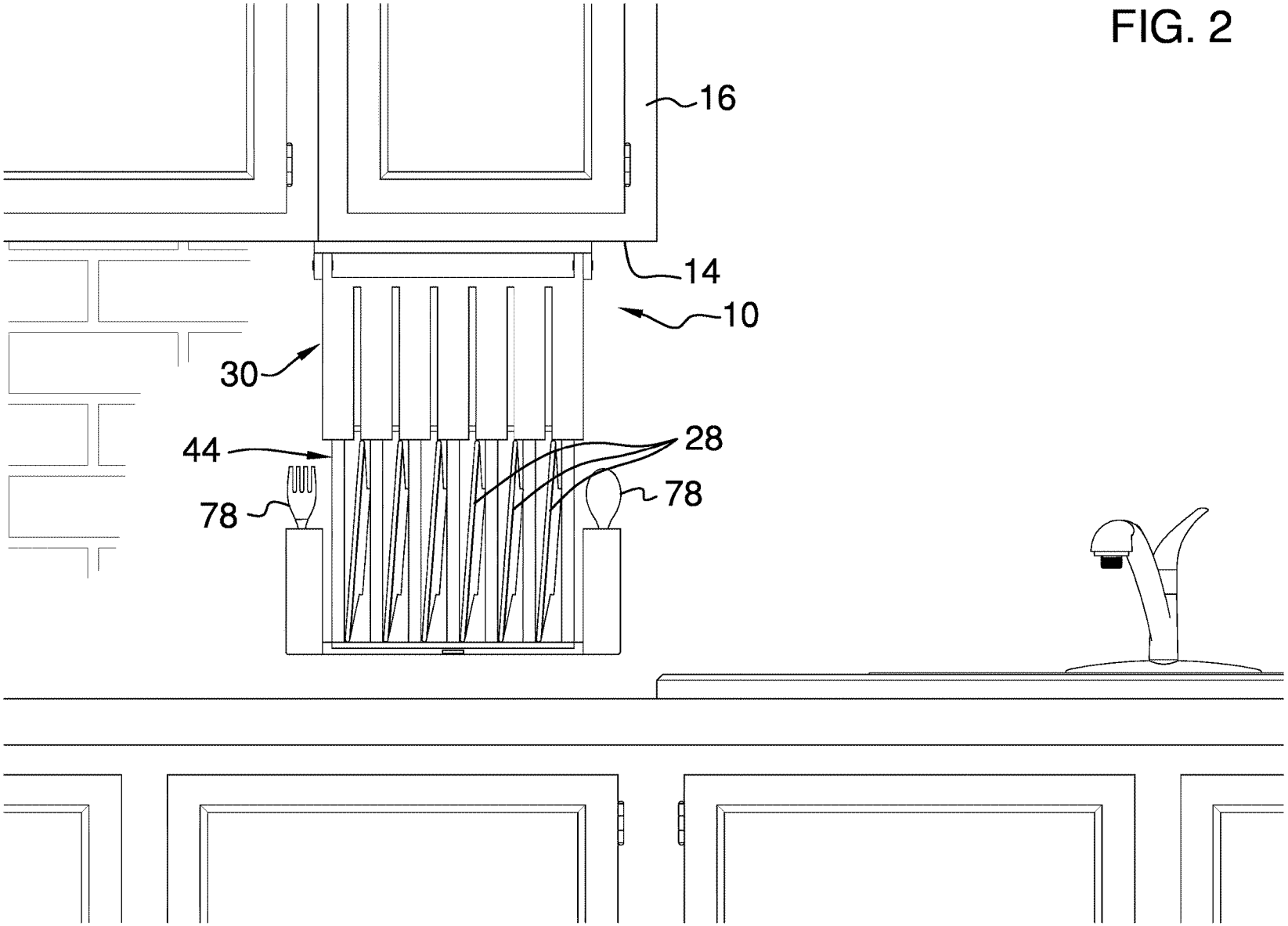
FIG. 2 is a front in-use view of an embodiment of the disclosure.
Figure 3:
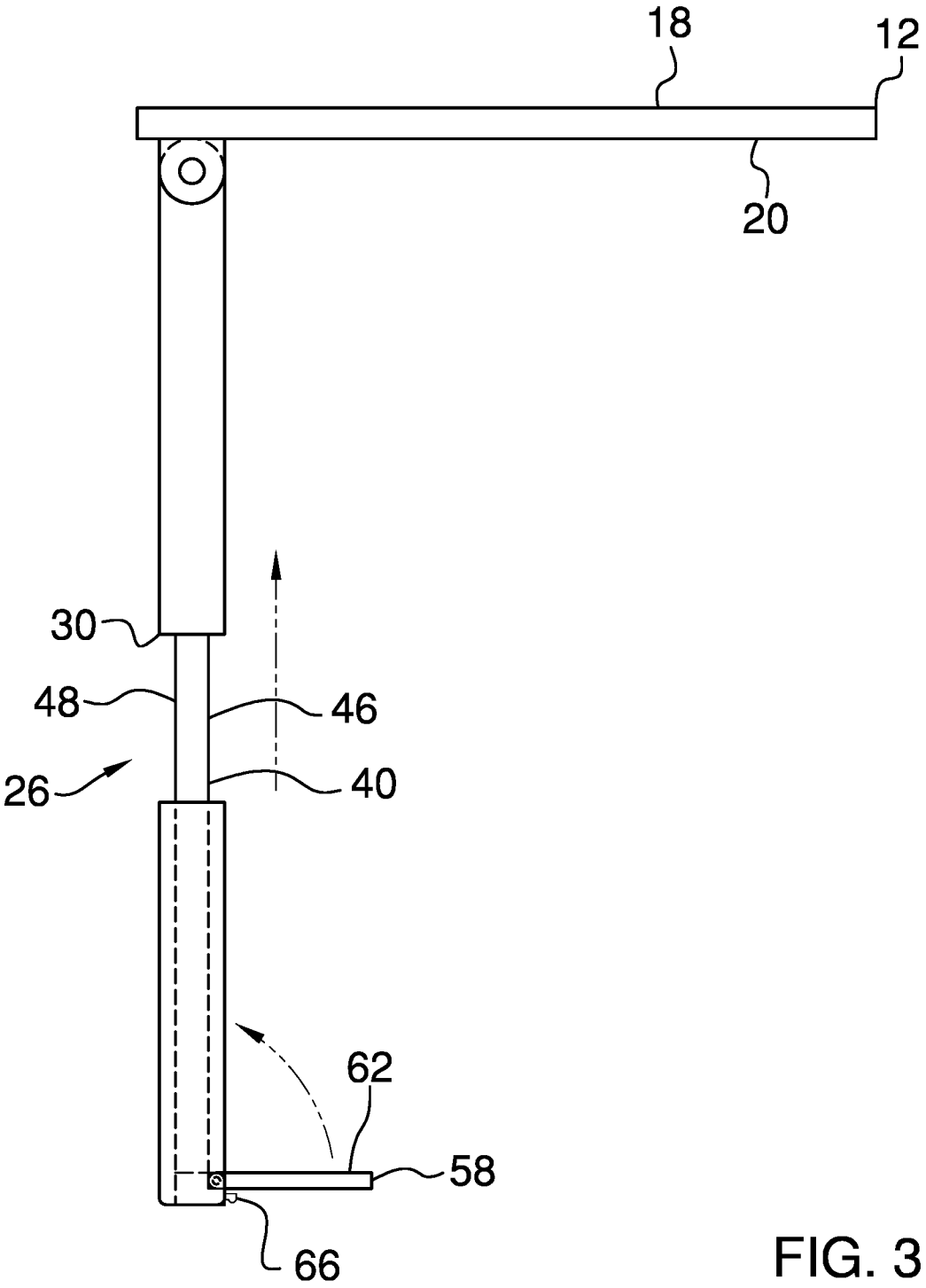
FIG. 3 is a side view of an embodiment of the disclosure.
Figure 7:
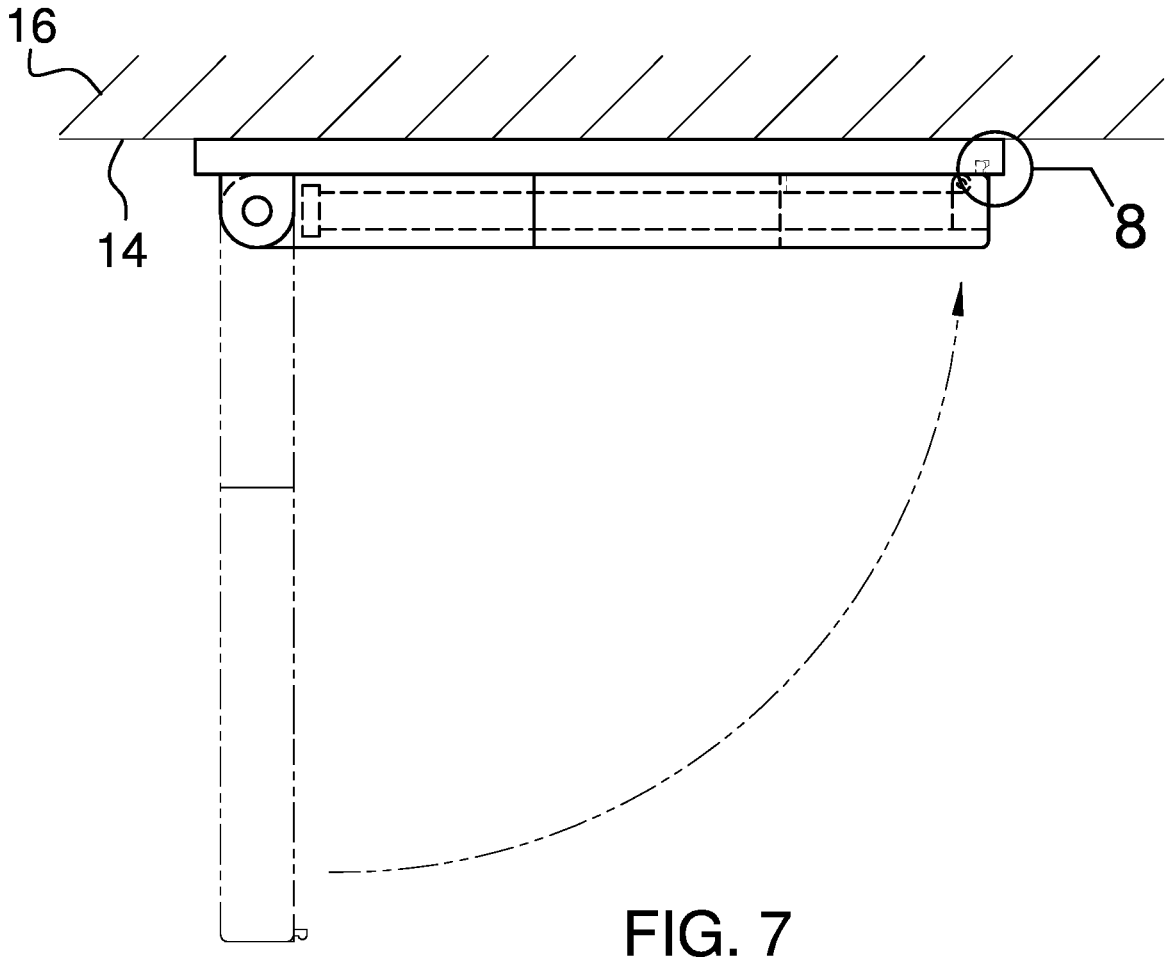
FIG. 7 is a side view of an embodiment of the disclosure.
Figure 8:
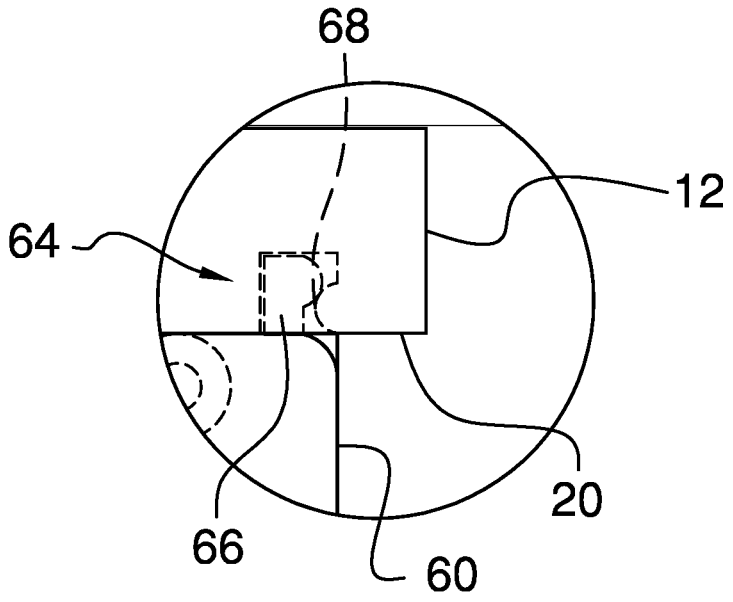
FIG. 8 is an enlarged side view of area "8" of an embodiment of the disclosure.

A plate support 26 is attached to the mount 12 and is extendable vertically downwardly from the mount 26 in a deployed position and is configured to receive vertically orientated plates 28, i.e. dinner plates, dessert plates and the like, such to facilitate drying of the plates 28 as shown in FIG. 2. The plate support 26 is positionable in a horizontal orientation in a stored position when the plate support 26 is free of the plates 28 as best shown in FIG. 7.

Figure 5:
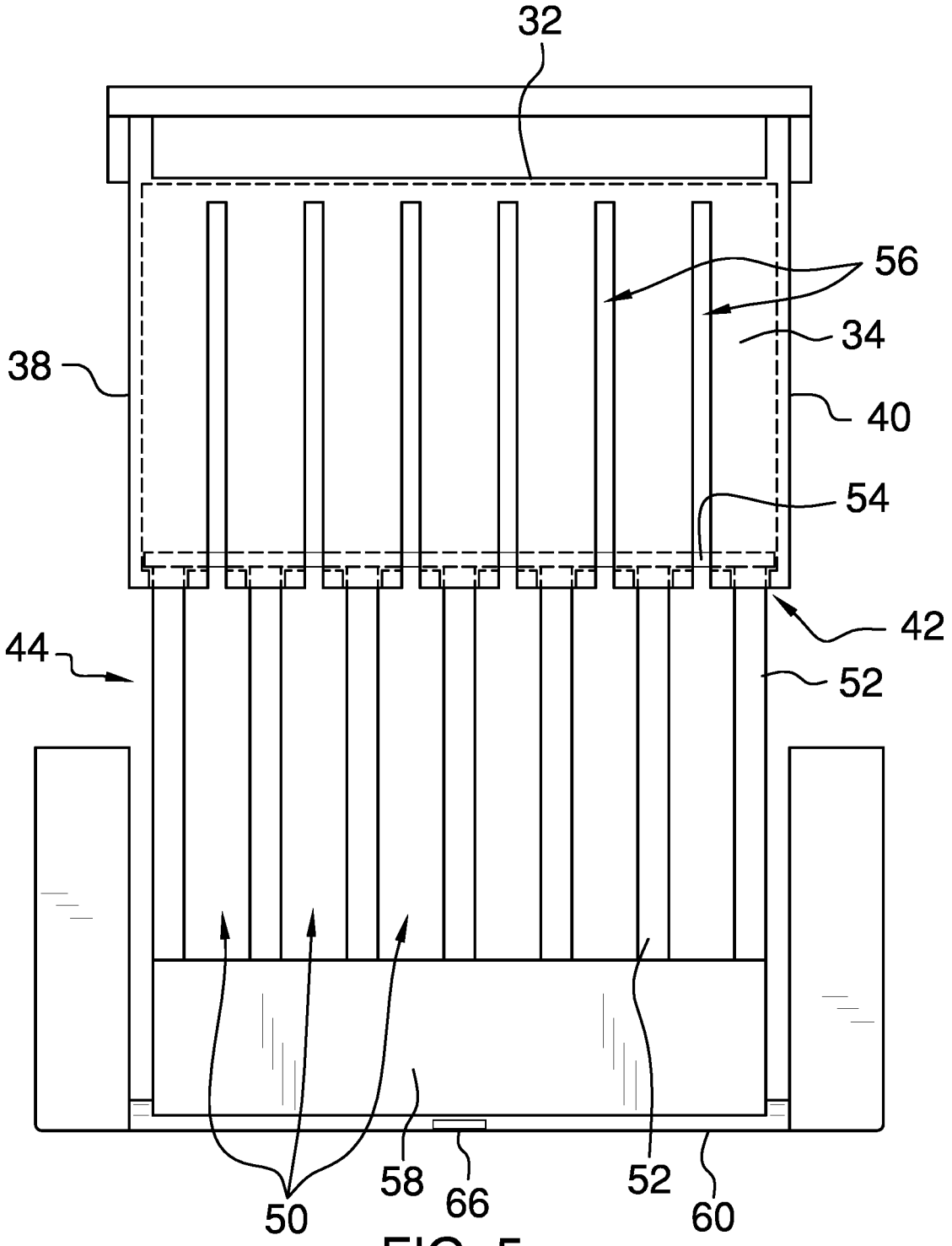
FIG. 5 is a front view of an embodiment of the disclosure.
Figure 6:
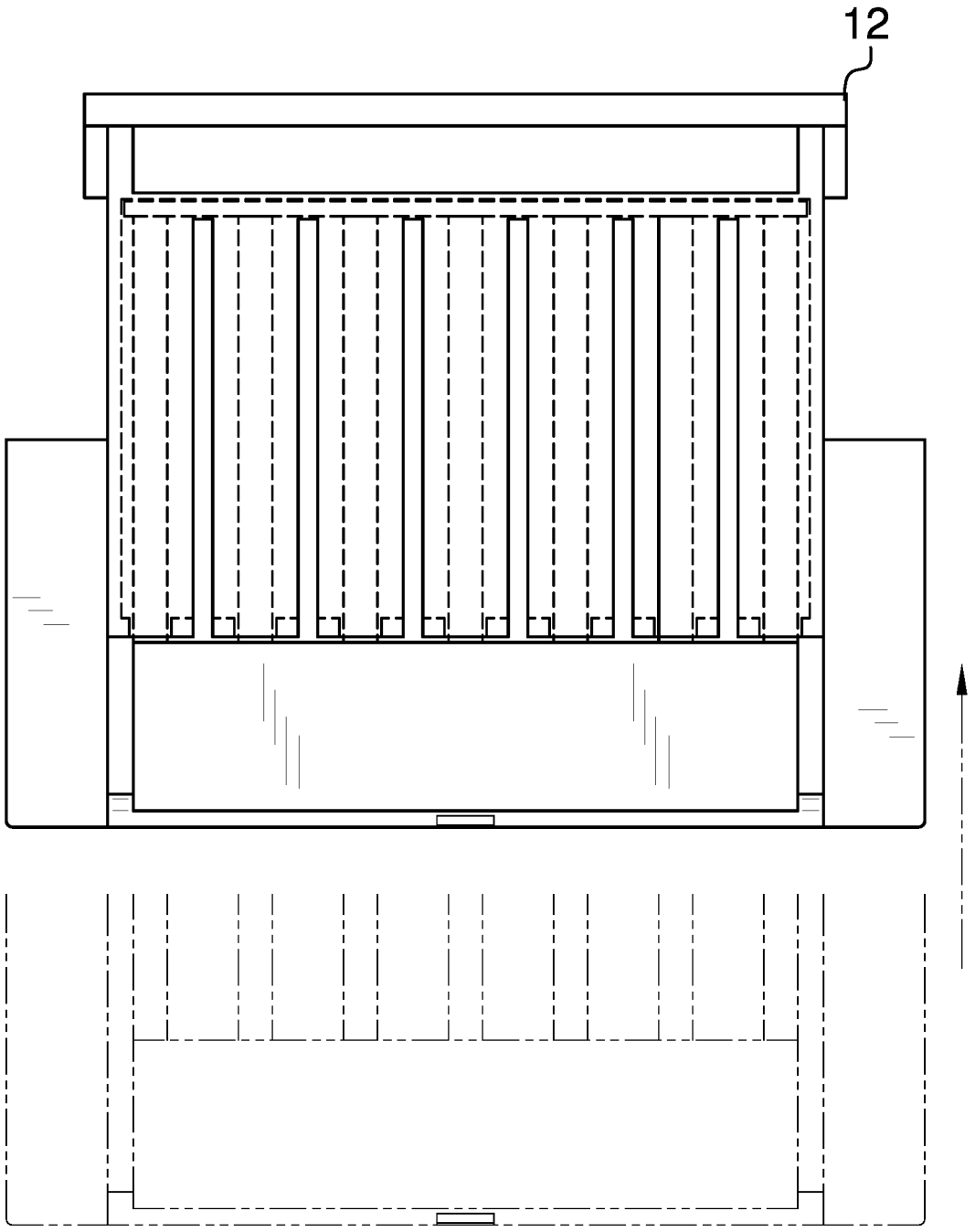
FIG. 6 is a front view of an embodiment of the disclosure.

The plate support 26 includes a housing 30 having a top wall 32, a front wall 34, a rear wall 36, a first lateral wall 38 and a second lateral wall 40. The housing 30 is pivotally coupled to the mount 12 such that the housing 30 is pivotable between the deployed position extending downwardly from the mount 12 and the stored position wherein the front wall 34 is horizontally orientated and facing upwardly toward the mount 12. A bottom side 42 of the housing is open. By being open, the bottom side 42 may include a single elongated opening or a plurality of laterally spaced openings as shown in FIG. 5.

A receiving rack 44 is removably extendable though the bottom side 42 and into the housing 30. The receiving rack 44 is positionable in a receiving position extending outwardly and hanging down from the housing 30 when the housing 30 is in the deployed position. The receiving rack 44 is extended into the housing 30 when the housing 30 is in the stored position. The receiving rack 44 has a front side 46 and a back side 48 when the receiving rack 44 is vertically orientated. A plurality of slots 50 that are vertically elongated extend through the front 46 and back 48 sides of the receiving rack 44. The slots 50 are laterally spaced from each other and each slot 50 is configured to receive at least one vertically orientated plate 28. The slots 50, in one embodiment, may be formed by a plurality of legs 52 and the bottom side 42 may include one opening for each leg 52. The legs 52 are retained in engagement with the housing 30 by one or more stops 54 which are held withing the housing 30. FIG. 5 includes a single stop 54 to which each leg 52 is attached. Alternatively, the receiving rack 44 may be mounted to the housing 30 with a conventional rail system such as is used with drawers to prevent the receiving rack 44 from completely leaving the housing 30. FIG. 5 also depicts an embodiment wherein the housing 30 includes vertical cut-outs 56 aligned with each slot 50 though such is not required for the system 10 to function properly.

A panel 58 is attached to the receiving rack 44 adjacent to a bottom edge 60 thereof and distal to the housing 30. The panel 58 has an upper surface 62 for supporting the plates 28 when the plates 28 are in the slots 50. The panel 58 is pivotally coupled to the receiving rack 44 and extends outwardly from the front side 46 when the receiving rack 44 is in the deployed position. The upper surface 62 faces the front side 46 when the receiving rack 44 is in the stored position.

A catch 64 releasably engages the plate support 26 and the mount 12 when the plate support 26 is in the stored position to releasably retain the plate support 26 in the stored position. Though the catch 64 may include any conventional retention device, in one embodiment the catch 64 comprises a detent 66 attached to the receiving rack 44. The detent 66 is extendable into and frictionally engaged with an indent 68 in the mount 12.

Figure 4:
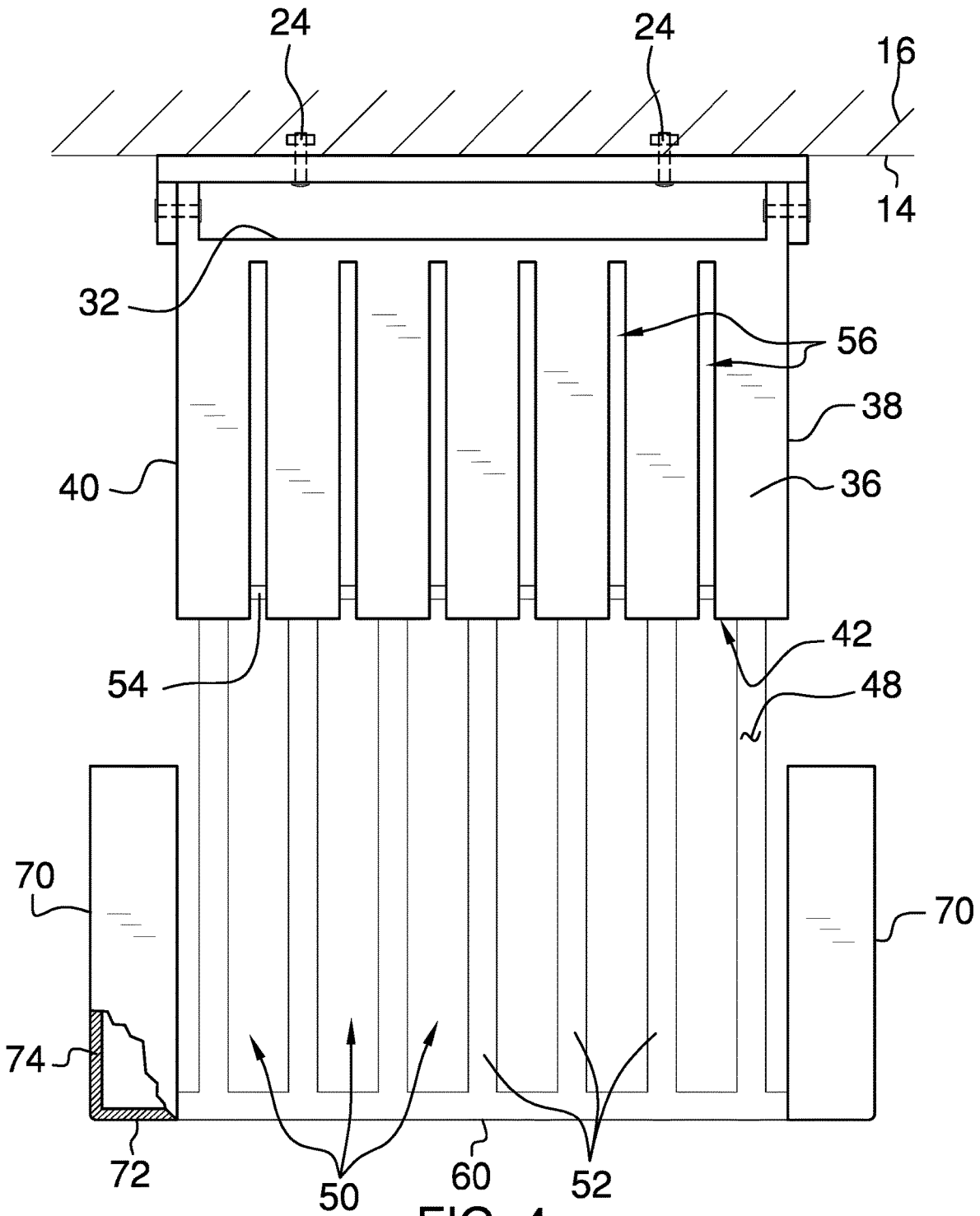
FIG. 4 is a rear view of an embodiment of the disclosure.

As shown best in FIG. 4, a sleeve 70 is attached to the plate support 26. The sleeve 70 has a bottom wall 72 and a perimeter wall 74 that is attached to and extends upwardly from the bottom wall 72. The sleeve 70 has an open top side 76 to receive silverware 78 and is vertically orientated when the plate support 26 is in the deployed position. The bottom wall 72 may include one or more drainage holes therein for allowing fluid to flow outwardly of the sleeve 70. The sleeve 70 is attached to a lateral edge of the receiving rack 44. As can be seen in the Figures, a pair of sleeves 70, attached to opposite lateral edges of the receiving rack 44, may be utilized.

In use, the system 10 is used in an area typically above a sink or adjacent thereto such that water may drain from the receiving rack 44 and sleeves into the sink. The receiving rack 44 is extended downwardly from the mount 12 as shown in FIG. 2 to allow plates 28 to be placed in the slots 50 for drying. Silverware 78 and other utensils used for eating and cooking may be positioned in the sleeves 70. This structure therefore allows for a dish rack that does not sit upon a counter and which can be stored, for space saving purposes, upwardly against the bottom side 14 of a cabinet 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An undercabinet mountable dish drying system comprising:

a mount being configured for being attached to a bottom surface of a cabinet; and a plate support being attached to the mount, the plate support being extendable vertically downwardly from the mount in a deployed position and being configured to receive vertically orientated plates such to facilitate drying of the plates, the plate support being positionable in a horizontal orientation in a stored position when the plate support is free of the plates; and wherein the plate support includes a housing having a top wall, a front wall, a rear wall, a first lateral wall and a second lateral wall, the housing being pivotally coupled to the mount, the housing being pivotable between the deployed position extending downwardly from the mount and the stored position wherein the front wall is horizontally orientated and faces upwardly toward the mount, a bottom side of the housing being open, and a receiving rack being removably extendable though the bottom side and into the housing, the receiving rack being positionable in a receiving position extending outwardly and hanging down from the housing when the housing is in the deployed position, the receiving rack being extended into the housing when the housing is in the stored position, the receiving rack having a front side and a back side when the receiving rack is vertically orientated, the receiving rack having a plurality of slots being vertically elongated and extending through the front and back sides, the slots being laterally spaced from each other, each slot being configured to receive at least one vertically orientated plate.

2. The undercabinet mountable dish drying system according to claim 1, further including a plurality of fasteners configured to extend through the mount and into the bottom surface of the cabinet.

3. The undercabinet mountable dish drying system according to claim 1, wherein the plate support includes a panel being attached to the receiving rack adjacent to a bottom edge thereof and distal to the housing, the panel having an upper surface for supporting the plates when the plates are in the slots.

4. The undercabinet mountable dish drying system according to claim 3, wherein the panel is pivotally coupled to the receiving rack and extending outwardly from the front side when the receiving rack is in the deployed position, the upper surface facing the front side when the receiving rack is in the stored position.

5. The undercabinet mountable dish drying system according to claim 1, further including a catch releasably engaging the plate support and the mount when the plate support is in the stored position to releasably retain the plate support in the stored position.

6. The undercabinet mountable dish drying system according to claim 1, further including a catch releasably engaging the plate support and the mount when the plate support is in the stored position to releasably retain the plate support in the stored position.

7. The undercabinet mountable dish drying system according to claim 6, further including the catch comprising a detent attached to the receiving rack, the detent being extendable into and frictionally engaged with an indent in the mount.

8. The undercabinet mountable dish drying system according to claim 1, further including a sleeve being attached to the plate support, the sleeve having a bottom wall and a perimeter wall being attached to and extending upwardly from the bottom wall, the sleeve having an open top side to receive silverware, the sleeve being vertically orientated when the plate support is in the deployed position.

9. The undercabinet mountable dish drying system according to claim 1, further including a sleeve being attached to the plate support, the sleeve having a bottom wall and a perimeter wall being attached to and extending upwardly from the bottom wall, the sleeve having an open top side to receive silverware, the sleeve being vertically orientated when the plate support is in the deployed position.

10. The undercabinet mountable dish drying system according to claim 9, wherein the sleeve is attached to a lateral edge of the receiving rack.

11. The undercabinet mountable dish drying system according to claim 4, further including a sleeve being attached to the plate support, the sleeve having a bottom wall and a perimeter wall being attached to and extending upwardly from the bottom wall, the sleeve having an open top side to receive silverware, the sleeve being vertically orientated when the plate support is in the deployed position.

12. The undercabinet mountable dish drying system according to claim 11, wherein the sleeve is attached to a lateral edge of the receiving rack.

13. An undercabinet mountable dish drying system comprising:

a mount being configured for being attached to a bottom surface of a cabinet, the mount having an upper surface and a lower surface, a plurality of apertures extending into the lower surface and through the upper surface, a plurality of fasteners configured to extend through the mount and into the bottom surface of the cabinet wherein each of the apertures has one of the fasteners therein;

a plate support being attached to the mount, the plate support being extendable vertically downwardly from the mount in a deployed position and being configured to receive vertically orientated plates such to facilitate drying of the plates, the plate support being positionable in a horizontal orientation in a stored position when the plate support is free of the plates, the plate support including:

a housing having a top wall, a front wall, a rear wall, a first lateral wall and a second lateral wall, the housing being pivotally coupled to the mount, the housing being pivotable between the deployed position extending downwardly from the mount and the stored position wherein the front wall is horizontally orientated and faces upwardly toward the mount, a bottom side of the housing being open;

a receiving rack being removably extendable though the bottom side and into the housing, the receiving rack being positionable in a receiving position extending outwardly and hanging down from the housing when the housing is in the deployed position, the receiving rack being extended into the housing when the housing is in the stored position, the receiving rack having a front side and a back side when the receiving rack is vertically orientated, the receiving rack having a plurality of slots being both vertically elongated, the slots each extending through the each of the front and back sides and being laterally spaced from each other, each slot being configured to receive at least one vertically orientated plate;

a panel being attached to the receiving rack adjacent to a bottom edge thereof and distal to the housing, the panel having an upper surface for supporting the plates when the plates are in the slots, the panel being pivotally coupled to the receiving rack and extending outwardly from the front side when the receiving rack is in the deployed position, the upper surface facing the front side when the receiving rack is in the stored position;

a catch releasably engaging the plate support and the mount when the plate support is in the stored position to releasably retain the plate support in the stored position, the catch comprising a detent attached to the receiving rack, the detent being extendable into and frictionally engaged with an indent in the mount; and a sleeve being attached to the plate support, the sleeve having a bottom wall and a perimeter watt being attached to and extending upwardly from the bottom wall, the sleeve having an open top side to receive silverware, the sleeve being vertically orientated when the plate support is in the deployed position, the sleeve being attached to a lateral edge of the receiving rack.

* * * * *